United States Patent [19]

Nalepa

[11] 4,305,020

[45] Dec. 8, 1981

[54] FAIL-SAFE SWITCH WHICH RENDERS HID LAMP INOPERATIVE UPON BREAKAGE OF OUTER ENVELOPE

[75] Inventor: Philip J. Nalepa, Oak Ridge, N.J.

[73] Assignee: Westinghouse Electric Corp., Pittsburgh, Pa.

[21] Appl. No.: 95,801

[22] Filed: Nov. 19, 1979

Related U.S. Application Data

[63] Continuation of Ser. No. 944,039, Sep. 20, 1978, abandoned.

[51] Int. Cl.[3] ..... H01J 25/50; H01J 13/46; H01J 19/78; H01K 1/62

[52] U.S. Cl. ..... 315/73; 315/75; 315/106; 313/184

[58] Field of Search ..... 313/25, 184; 315/73, 315/74, 75, 58, 106, 119, 340

[56] References Cited

U.S. PATENT DOCUMENTS

| | | | |
|---|---|---|---|
| 4,013,919 | 3/1977 | Corbley | 315/74 |
| 4,090,105 | 5/1978 | Koo | 315/74 |
| 4,143,301 | 3/1979 | Strauss et al. | 315/73 |
| 4,195,251 | 3/1980 | Bamberg | 315/73 |
| 4,208,614 | 6/1980 | Strauss et al. | 315/73 |
| 4,233,542 | 11/1980 | Oostuogels et al. | 315/73 |

FOREIGN PATENT DOCUMENTS

| | | | |
|---|---|---|---|
| 267753 | 4/1970 | U.S.S.R. | 315/73 |

*Primary Examiner*—Saxfield Chatmon, Jr.
*Attorney, Agent, or Firm*—R. S. Lombard

[57] ABSTRACT

A high-intensity discharge lamp which has a lamp current-interrupting device in series circuit with the arc tube which is sensitive to any breach occurring in the protective outer envelope. The current-interrupting constituent of the device initially incorporated into the lamp comprises vanadium sesquioxide. The device has predetermined dimensions and an initial predetermined operating resistance. During normal operation of the lamp the device operates at a predetermined temperature sufficiently low so that said device is stable in the presence of the non-reactive atmosphere enclosed by the outer envelope. The predetermined temperature also being sufficiently high so that upon a breach occurring in the outer envelope permitting oxygen to enter, the vanadium sesquioxide rapidly converts to vanadium pentoxide to interrupt the continuity of the power circuit to the arc tube and prevent the operation of the lamp.

14 Claims, 2 Drawing Figures

FAIL-SAFE SWITCH WHICH RENDERS HID LAMP INOPERATIVE UPON BREAKAGE OF OUTER ENVELOPE

This is a continuation of application Ser. No. 944,039, filed Sept. 20, 1978, now abandoned.

BACKGROUND OF THE INVENTION

It has been reported that high-intensity discharge (HID) lamps, such as high-pressure, mercury-vapor lamps, can constitute a safety hazard to people in close proximity to the lamps if the protective outer envelope is broken permitting short wavelength ultraviolet radiations to escape.

A number of lamps containing safety devices for preventing people from being exposed to short wavelength ultraviolet radiations have been developed. One such lamp is disclosed in U.S. Pat. No. 4,013,920 dated Mar. 22, 1977, issued to John Petro. This lamp utilizes a resilient safety switch positioned proximate the inner surface of the dome portion of the protective outer envelope in contact with an extremity of a resilient leaf-spring support portion of the arc tube frame to maintain the switch in a closed position. When the envelope is shattered the normally closed switch will open to break the electrical path to the arc tube, thereby rendering the lamp inoperative.

U.S. Pat. No. 4,013,919 dated Mar. 22, 1977 issued to Corbley discloses a fuse heater and shunting thermal switch connected in series with the arc tube and located within the outer envelope. If the outer envelope is broken, air cools the switch so that it opens. Current flow through the heater raises the temperature and causes it to oxidize, thereby opening the circuit and disabling the lamp.

Russian Pat. No. 1,322,142/24-7 published Apr. 2, 1970 by Sulatskov et al. discloses a high-pressure discharge lamp incorporating a cerium-containing link which oxidizes when exposed to air and breaks to open the arc tube energizing circuit, thereby preventing the emission of UV radiation upon the breakage of the outer envelope.

SUMMARY OF THE INVENTION

The basic HID lamp comprises an elongated radiation-transmitting arc tube which is enclosed by and supported within a light-transmitting protective outer envelope which is opaque to short wavelength ultraviolet radiations. The arc tube conventionally encloses a discharge-sustaining filling and has electrodes operatively positioned therein proximate the ends thereof. Electrical lead-in means are sealed through the arc tube and electrically connected to the lamp electrodes and an electrical adapter means, such as a screw-type base, is affixed to the outer surface of the protective envelope to facilitate electrical connection of the lamp to a source of electrical power. Electrical conductor means electrically connect the electrical adapter means to the electrical lead-ins. The environment included between the arc tube and the protective envelope is non-reactive with respect to lamp components exposed thereto. In accordance with conventional practices, the lamp has a predetermined operating current and a predetermined start-up current which is greater than the predetermined lamp operating current.

In accordance with the present invention, there is provided a lamp-current-interrupting device included in series-circuit arrangement with the electrical conductor means. The current-interrupting device has predetermined dimensions and comprises vanadium sesquioxide and has an initial predetermined operating resistance, when coupled with the operating environment within the protective envelope causing the current-interrupting device under normal lamp operating conditions to be maintained at a predetermined temperature sufficiently low that the device is stable in the presence of the non-reactive atmosphere which is normally enclosed by the protective envelope. The predetermined temperature of the current-interrupting device under normal lamp operating conditions is also sufficiently high that upon any breach occurring in the protective envelope which permits oxygen to enter the operating environment, the vanadium sesquioxide will rapidly convert to vanadium pentoxide to interrupt the continuity of the power circuit to the arc tube and prevent the operation of the lamp.

BRIEF DESCRIPTION OF THE DRAWINGS

For a better understanding of the invention, reference may be had to the preferred embodiment, exemplary of the invention shown in the accompanying drawings, in which.

DESCRIPTION OF THE PREFERRED EMBODIMENTS

Figure 1:
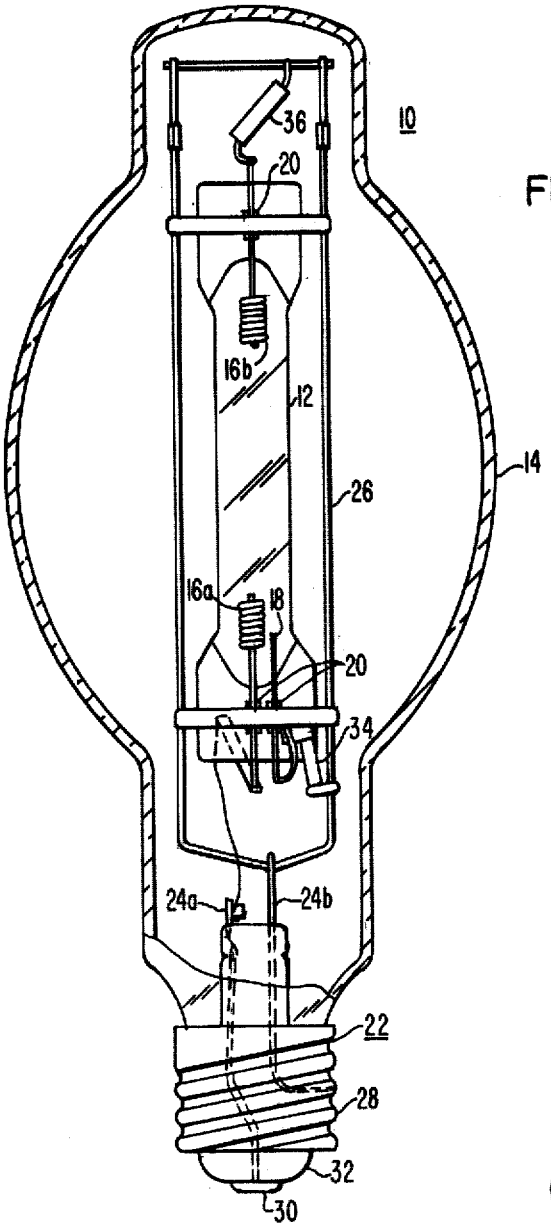
FIG. 1 is an elevational view showing a high-intensity-discharge lamp which incorporates a lamp-current-interrupting device in accordance with the present invention.

In FIG. 1 is shown a high-intensity-discharge lamp which, in this embodiment, is a high-pressure, mercury-vapor discharge lamp 10. The lamp 10 comprises an elongated radiation-transmitting arc tube 12 which is enclosed by and supported within a light-transmitting protective outer envelope 14 which is opaque to the short wavelength ultraviolet radiations which are generated within the arc tube during lamp operation. The arc tube 12 is conventionally made of ultraviolet transmitting material such as quartz. The arc tube has operating electrodes **16*a*, 16*b* operatively positioned proximate the ends thereof and a conventional starting electrode 18 is positioned proximate one of the operating electrodes 16*a*. Electrical lead-in means such as ribbon conductors 20 are sealed through the arc tube and connected to the electrodes 16 and 18**.

An electrical adapter such as a conventional screw-type base 22 is affixed to the outer surface of the protective envelope 14 to facilitate electrical connection for the lamp 10 to a source of electrical power and electrical conductors **24*a* and 24*b* serve to connect the screw-type base to the ribbon conductors 20. In the embodiment as shown, electrical connection is made to the uppermost electrode 16*b* through the conductor 24*b* and the arc tube supporting frame 26 and connection to the other electrode is made through the conductor 24*a* which connects to the base 22. In accordance with conventional practices, the base 22 comprises a shell portion 28 and center eyelet portion 30 which are separated by an insulator 32**.

A conventional starting resistor 34 is connected between the arc tube supporting frame 26 and the starting electrode 18. When the lamp operating potential is applied to the base member 22, an initial discharge is established between the starting electrode 18 and the adjacent operating electrode 16*a*. After the starting gas in the arc tube has been ionized, the main discharge can be established between the main operating electrodes 16*a*, 16*b*.

The environment included between the arc tube 12 and the protective outer envelope 14 is selected to be non-reactive with respect to lamp components exposed to it and an atmosphere of noble gas, nitrogen or a vacuum will serve this purpose. In accordance with conventional practices, the lamp has a predetermined operating current which in the case of a 400-watt mercury lamp is approximately 3.4 amps and a predetermined start-up current which in the case of a 400-watt lamp is approximately 5.2 amps.

Figure 2:
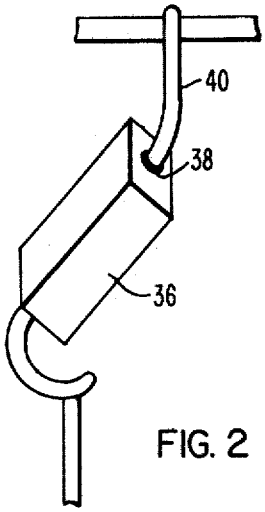
FIG. 2 is a fragmentary enlarged side elevation of the current interrupting device setting forth mounting details therefor.

In accordance with the present invention, a lamp-current-interrupting device 36 is included in series circuit arrangement between electrode 16*b* and the supporting frame 26 as shown in FIG. 2. The device 36 has predetermined dimensions and has as the current-interrupting constituent thereof vanadium sesquioxide ($V_2O_3$) and has an initial predetermined operating resistance. The operating environment within the envelope, coupled with the dimensions of the device and the operating resistance thereof causes the current-interrupting device 36 under normal lamp operating conditions to be at a predetermined temperature sufficiently low that the device is stable in the presence of the non-reactive atmosphere which is normally enclosed by the protective envelope 14. The predetermined temperature of the current-interrupting device 36 under normal lamp operating conditions also is sufficiently high that upon any breach occurring in the protective outer envelope 14, permitting oxygen to enter the operating environment, the vanadium sesquioxide will rapidly convert to vanadium pentoxide ($V_2O_5$) to interrupt the continuity of the power circuit to the arc tube 12 and prevent the operation of the lamp. This break in the power circuit occurs as a result of the device 36 fusing at the predetermined high temperature.

In its preferred form, the device 36 comprises vanadium sesquioxide ($V_2O_3$) dispersed in a vitreous binder. The device may be prepared as follows:

PREPARATION OF THE $V_2O_3$

The $V_2O_3$ is preferably prepared by hydrogen reduction of ammonium metavanadate ($NH_4VO_3$) at about 700° C. for about 3 hours.

PREPARATION OF THE BINDER

The binder is prepared by mixing together stoichiometric amounts of barium carbonate and orthoboric acid and heating in air to about 1000° C. for about 2 hours. This produces a material which is amorphous, as evidenced by X-ray diffraction, and is presumably $BaO \cdot 4B_2O_3$. The $BaO \cdot 4B_2O_3$ is ground to a powder in a ball mill to pass through a 60 mesh sieve.

PREPARATION OF THE MASS

The $V_2O_3$ and binder are combined as powders according to the following:

$$100\text{-}X \text{ wt.\% } (V_2O_3) + X \text{ wt.\% } (BaO \cdot 4B_2O_3)$$

Proportions of 30% binder and 70% vanadium sesquioxide have been found to work well. Preferably the powders are mixed as a slurry with methanol, air dried, then incorporated with an organic fugitive binder such as, "Duco Cement", a trade mark for butyl acetate, so as to be about 6.8 weight percent of the mixture with acetone as the solvent. The device 36 is then made from about 0.1 gram of the powder which is again air dried, ground to pass 60 mesh sieve and pressed in a hydraulic press at about 90,000 psi in a die yielding a device 36 having dimensions of 1.91 cm×0.145 cm×0.145 cm. The green pressed device 36 is air baked at 300° C., then sintered in an argon flow (970 cc/min) for about 2 hours at about 1000° C. producing a device with an operating resistance of about 0.69 ohms.

It has been found that the vanadium sesquioxide should be from about 50 to 100 weight percent of the device and the binder should be from about 50 to 0 weight percent of the device. Typically, 30 wt.% binder is used for best results. The electrical terminals for the interrupting device 36 can be formed of silver. As an example, the terminals are fabricated using a commercially available silver paste sold by E. I. Dupont Co. under the trade designation No. 6337 which incorporates silver glass frit and an organic solvent. Leads 40 are attached to the terminals 38 after the curing of the frit by mechanically wrapping 0.010 in. (0.254 mm.) wire around the terminations 38.

The device 36 with leads 40 attached is preferably inserted in the circuit in a predetermined position as shown in FIG. 1 in close proximity to the arc tube, but away from the base 22 to prevent premature oxidation of the $V_2O_3$ due to excessive heat during sealing of the lamp 10. An insulating material such as glass gauze may also be wrapped around device 36 to maintain it at the predetermined desired operating temperature.

In testing the current-interrupting device 36 it was found that the predetermined temperature of the device should be between about 700° C. to 900° C. so that the arc tube will be rendered inoperable within about 2 to 4 minutes. The current-interrupting device as described has an initial operating resistance of about 0.692 ohm which dissipates about 8 watts in a 400 watt lamp for a 2 percent power loss at an operating current of 3.4 amps. Preferably the initial operating resistance of the device should be less than 0.7 ohms in a 400 watt lamp.

The lamp current interrupting device 36 functions as follows: when a breach or leak develops in the outer protective envelope the $V_2O_3$, which has a high melting point of 2050° C. and relatively low resistivity of about $10^{-3}$ ohm-cm, of the device 36 oxidizes to $V_2O_5$ which has a low melting point of 680° C. and a relatively high resistivity of about $10^6$ ohm-cm. The $I^2R$ heating of the device 36, principally $V_2O_3$, causes it to heat to temperatures above the $V_2O_5$ melting temperature so that upon oxidation of the $V_2O_3$, the device 36 readily fuses and interrupts the power circuit extinguishing the arc. The 8–9 orders of magnitude increase in resistivity that accompanies this oxidation serves to increase the $I^2R$ heating when the current is maintained fairly constant by the lamp ballast, and this further enhances the oxidation kinetics and fusing mechanism so as to become self-destructing.

The binder is employed mostly for reason of convenience in that, the use of a high resistance binder offers a means of tailoring the resistance of the current-interrupting device and, the melting temperature of the binder is about 900° C., much lower than that of $V_2O_3$, which lends itself to processing with readily available equipment.

I claim:

1. In combination with a high-intensity discharge lamp comprising an elongated radiation-transmitting arc tube which is enclosed by and supported within a light-transmitting protective outer envelope which is opaque to short wavelength ultraviolet radiations, said arc tube enclosing a discharge-sustaining filling and having electrodes operatively positioned therein proximate the ends thereof, electrical lead-in means sealed through said arc tube and electrically connected to said electrodes, electrical adapter means affixed to the outer surface of said protective envelope to facilitate electrical connection of said lamp to a source of electrical power, and electrical conductor means electrically connecting said electrical adapter means to said electrical lead-in means, the environment included between said arc tube and said protective envelope being non-reactive with respect to lamp components exposed thereto, and said lamp having a predetermined operating current and a predetermined start-up current which is greater than said predetermined lamp operating current, the improvement which comprises:

said electrical conductor means including in series-circuit arrangement a lamp-current-interrupting device having predetermined dimensions and comprising vanadium sesquioxide and having an initial predetermined operating resistance, the predetermined dimensions of said current-interrupting device coupled with the predetermined operating resistance thereof and the normal operating environment within said protective outer envelope causing said current-interrupting device under normal lamp operating conditions to be at a predetermined temperature sufficiently low that said device is stable in the presence of said non-reactive atmosphere which is normally enclosed by said protective envelope, and the predetermined temperature of said current-interrupting device under normal lamp operating conditions also being sufficiently high that upon any breach occurring in said protective outer envelope permitting oxygen to enter said operating environment, said vanadium sesquioxide will rapidy convert to vanadium pentoxide to interrupt the continuity of the power circuit to the arc tube and prevent the operation of the lamp.

2. The lamp of claim 1, wherein said device is in a predetermined position with respect to said arc tube.

3. The lamp of claim 1, wherein said predetermined temperature is from about 700° C. to about 900° C.

4. The lamp of claim 1, wherein said device comprises vanadium sesquioxide dispersed in a vitreous binder.

5. The lamp of claim 4, wherein said vitreous binder comprises $BaO{\cdot}4B_2O_3$.

6. The lamp of claim 5, wherein said vanadium sesquioxide is from about 50 to 100 weight percent of said device and said binder is from about 50 to 0 weight percent of said device.

7. The lamp of claim 6, wherein said vanadium sesquioxide is 70 weight percent of said device and said binder is 30 weight percent of said device.

8. In combination with a high-intensity discharge lamp comprising a sealed elongated radiation-transmitting arc tube which is enclosed by and supported within a sealed light-transmitting protective outer envelope which is opaque to short wavelength ultraviolet radiations, said arc tube enclosing a discharge-sustaining filling and having electrodes operatively positioned therein proximate the ends thereof, electrical lead-in means extending through said arc tube and electrically connected to said electrodes, electrical adapter means affixed to the outer surface of said protective envelope to facilitate electrical connection of said lamp to a source of electrical power, and electrical conductor means electrically connecting said electrical adapter means to said electrical lead-in means, the environment included between said arc tube and said protective envelope being non-reactive with respect to lamp components exposed thereto, and said lamp having a predetermined normal operating current and a predetermined start-up current, the improvement which comprises:

a lamp-current-interrupting device included in series-circuit arrangement with said electrical conductor means to conduct lamp current when there occurs a breach of said outer protective envelope to permit oxygen to enter therein, said lamp-current-interrupting device having predetermined dimensions and comprising vanadium sesquioxide and having a predetermined electrical resistance, the predetermined dimensions of said lamp-current-interrupting device coupled with the predetermined electrical resistance thereof and the normal operating environment within said protective outer envelope causing said current-interrupting device, as included in current-conducting series-circuit arrangement with said electrical conductor means, to be at a predetermined temperature sufficiently low that said current-interrupting device is stabe in the presence of said non-reactive atmosphere which is normally enclosed by said protective envelope, and upon a breach of said outer protective envelope, the predetermined temperature of said current-interrupting device as included in current-conducting series-circuit arrangement with said electrical conductor means being sufficiently high that contact with oxygen admitted into said breached outer protective envelope will rapidly convert said vanadium sesquioxide to vanadium pentoxide which in turn will interrupt the continuity of said electrical conductor means to prevent the operation of said lamp.

9. The lamp of claim 8, wherein said device is in a predetermined position with respect to said arc tube.

10. The lamp of claim 8, wherein said predetermined temperature is from about 700° C. to about 900° C.

11. The lamp of claim 8, wherein said device comprises vanadium sesquioxide dispersed in a vitreous binder.

12. The lamp of claim 11, wherein said vitreous binder comprises $BaO{\cdot}4B_2O_3$.

13. The lamp of claim 12, wherein said vanadium sesquioxide is from about 50 to 100 weight percent of said device and said binder is from about 50 to 0 weight percent of said device.

14. The lamp of claim 13, wherein said vanadium sesquioxide is 70 weight percent of said device and said binder is 30 weight percent of said device.

* * * * *